US005498001A

United States Patent [19]

Franks et al.

[11] Patent Number: 5,498,001

[45] Date of Patent: Mar. 12, 1996

[54] ARCHERY TARGET

[76] Inventors: Johnny D. Franks, 2306 Middle Creek, Kingwood, Tex. 77339; Richard Kinas, 847 FM 1314 #706, Porter, Tex. 77365

[21] Appl. No.: 29,387

[22] Filed: Mar. 10, 1993

[51] Int. Cl.[6] ..... F41J 3/00

[52] U.S. Cl. ..... 273/403

[58] Field of Search ..... 273/404–408, 273/409

[56] References Cited

U.S. PATENT DOCUMENTS

| | | | |
|---|---|---|---|
| 2,812,947 | 11/1957 | Fatzinger | 273/404 |
| 3,367,660 | 2/1968 | DiMaggio | 273/404 |
| 4,054,288 | 10/1977 | Perrine, Jr. | 273/408 |
| 4,203,600 | 5/1980 | Brown | 273/408 |
| 4,477,082 | 10/1984 | McKenzie et al. | 273/408 |
| 4,643,434 | 2/1987 | Carlin | 273/408 |
| 4,657,261 | 4/1987 | Saunders | 273/408 |
| 4,695,060 | 9/1987 | Pilgrim | 273/404 |
| 5,002,285 | 3/1991 | Morrell | 273/408 |
| 5,308,084 | 5/1994 | Morrell | 273/403 |

FOREIGN PATENT DOCUMENTS

| | | | |
|---|---|---|---|
| 706287 | 3/1965 | Canada | 273/404 |
| 2932778 | 3/1981 | Germany | 273/404 |

*Primary Examiner*—Vincent Millin

*Attorney, Agent, or Firm*—Sughrue, Mion, Zinn, Macpeak & Seas

[57] ABSTRACT

A three dimensional archery target is provided having a configuration of a game animal. The target is molded in one piece of foam material and includes a body portion, a head portion and leg portions. Support members may be integrally molded in the leg portions which extend from the bottoms thereof to facilitate supporting the target in a vertical upright manner. The body portion of the target has a sheet of penetration resistant cloth material integrally molded therein and disposed in a longitudinal vertical median plane of the body. Thus, the arrows will only penetrate halfway through the body portion of the target which may then be reversed for additional use.

9 Claims, 1 Drawing Sheet

ARCHERY TARGET

BACKGROUND OF THE INVENTION

The present invention is directed to an archery target and more specifically to a target of foam material having the shape of an animal body with a sheet of cloth integrally molded in the foam material in the vertical median plane extending lengthwise of the foam animal in the kill area.

Single piece, lightweight foam animal targets are known which approximate the size and shape of the corresponding live animal even though the actual primary target area is limited only to the approximate location of the upper chest cavity in the region of the heart and lungs. Since this area comprises a primary aiming point, the target in this area is relatively quickly destroyed even though other areas of the target are only slightly damaged. The primary target area of the target will accept only so many strikes before it disintegrates into several pieces meaning the entire target must be replaced. This involves a substantial expenditure, especially when relatively large targets are concerned.

In order to overcome the drawbacks associated with the single piece, lightweight foam animal target described above, the U.S. Patent to McKenzie et al. (U.S. Pat. No. 4,477,082) discloses a three-dimensional archery target simulating an animal and having a replaceable segment corresponding to the physiological target area of an animal. The segments of the animal target may be comprised of polyurethane foam with the replaceable target segment having a higher density than the remaining body segments.

The U.S. Patent to Pilgrim (U.S. Pat. No. 4,695,060) discloses a reversible archery target with a central divider panel of heavy utility grade polypropelyne material which divides the entire interior of the target into two portions, each filled with cotton material. The exterior covering of the target comprises two layers of utility grade polypropelyne and an outer layer of heavy burlap having various target shapes silkscreened on both exterior sides.

The U.S. Patent to Morrell (U.S. Pat. No. 5,002,285) disclosed an archery target having a free floating central core formed by a plurality of stacked sheets of tightly woven nylon material. The sheets are oriented parallel to the front and back faces of the target and serve to absorb arrow impact without being penetrated. The central core is completely surrounded by compressed cotton packing disposed within a cardboard frame. The frame, compressed cotton and central core are contained within a polyethylene bag to form a moisture barrier and a plurality of layers of nylon are wrapped around the moisture barrier.

The U.S. Patents to Meyer (U.S. Pat. Nos. 3,088,738, 4,076,246, 4,235,444 and 4,491,328) disclose laminated target constructions having one or more layers of foam material, other fibrous material and sheets of plastic material. In targets of this type, the arrow is designed to penetrate as many of the laminations or layers as necessary to stop the arrow.

The U.S. Patents to Roloff (U.S. Pat. Nos. 3,476,390 and 3,762,709 ) are directed to non-piercing archery targets having a plurality of laminations using a plurality of layers of synthetic or natural foam. The Roloff-patent '390 discloses a sheet of penetration resistant rubber material between two layers of high density foam material. The laminations are held together by either a fabric bag-like material or by a rim which clamps the laminations together. The Roloff patent '709 also uses a plurality of layers of foam material but provides resilient means to allow one of the foam layers to move relative to the other for the purpose of absorbing impact.

SUMMARY OF THE INVENTION

The present invention provides a new and improved archery target having an overall shape simulating an animal such as a deer comprised of a single piece of foam material having a penetration resistant fabric layer integrally molded in the foam material in the longitudinal median plane of the animal in the primary target or kill area.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
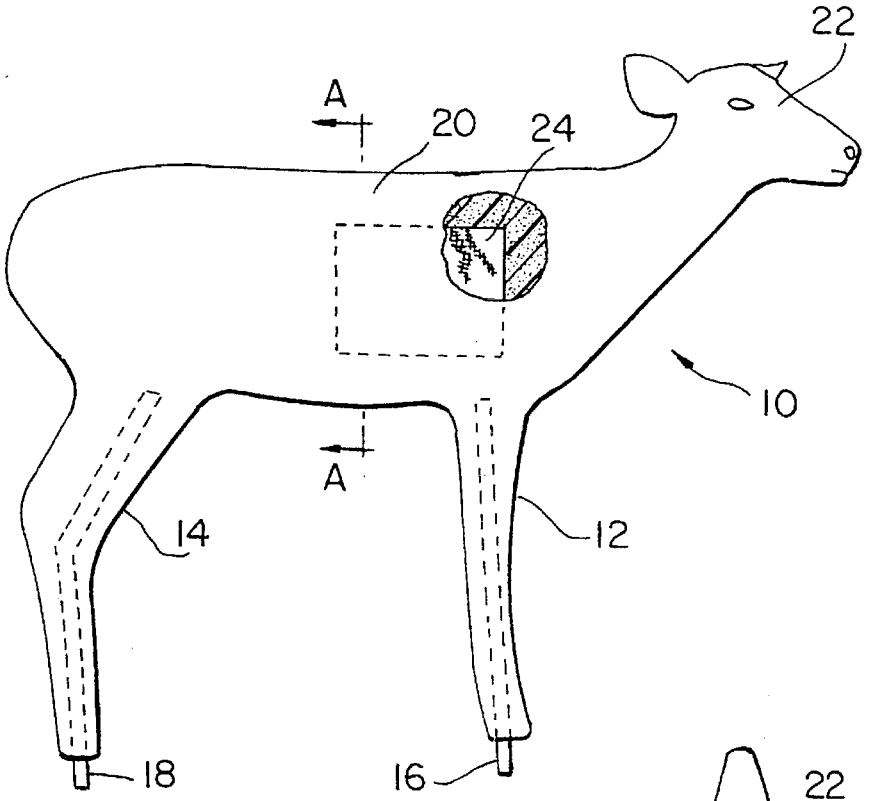
FIG. 1 is a side elevational view of a foam archery target in the shape of an animal according to the present invention.
Figure 2:
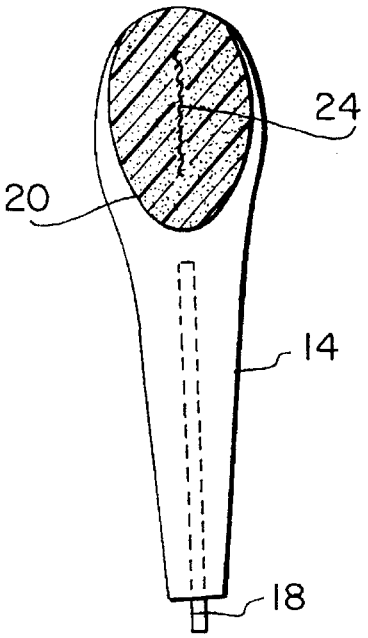
FIG. 2 is a sectional view taken along the line A—A of FIG. 1.
Figure 3:
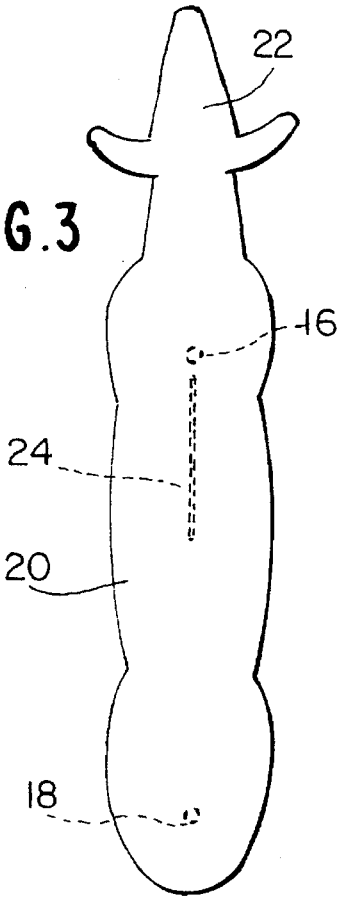
FIG. 3 is a top plan view of the archery target shown in FIG. 1.

The archery target 10 as shown in FIG. 1, is in the form of a deer, but could be manufactured to resemble any other game animal. A polyurethane elastomeric foam is used for the animal target and is molded in a single one piece construction. Instead of molding the animal target with four separate legs having individual feet, a single front leg or support 12 is provided and a single rear leg or support 14 is provided. From the side view as shown in FIG. 1, the legs bear an outline resemblance to the real front and rear legs of a deer. A front support 16 and a rear support 18 are integrally molded into the front and rear legs 12 and 14 respectively and extend outwardly from the bottoms of the legs for insertion into the ground or in any other suitable support or stand (not shown). If the supports 16 and 18 are to be pushed into the ground, the ends of the supports could be pointed to facilitate pushing the supports into the ground. The supports 16 and 18 may be made of any suitable material such as wood, plastic or metal. The body 20 and the head 22 of the deer are substantially life size and have a thickness corresponding to the thickness of the body and head of a deer as shown in FIGS. 2 and 3.

At least one sheet of cloth 24 having a substantially rectilinear outline is embedded in the body of the animal target during the molding process. The cloth is disposed in the central median plane of the animal target as best seen in FIGS. 2 and 3. The size of the cloth used for a deer target would be approximately 10 inches square and would be centered within the body 20 in the kill zone of the target which could be depicted on the surface of the target. The size of the cloth will be dependent upon the size of the kill zone for each target, which in turn will vary with the size of the animal under consideration. The edges of the cloth piece 24 are spaced from the edges of the target body so that the cloth sheet 24 is suspended completely within the mass of foam material constituting the body.

The cloth may be a Rachel knitted fabric, 1000 Denier polyester, 3 bar construction. The cloth is 100% polyester and has a weight from 10 to 30 ounces per square yard. A plurality of layers of the cloth material may be superimposed upon each other to provide additional penetration resistance. Thus, with lighter weight cloth material, 3 superimposed layers of material would provide greater penetration resistance to the arrows.

The foam material may have a density which may range from 2–6 pounds per cubic foot. As an arrow penetrates the foam material, the cloth layer or layers will stop the penetration of the arrow through the target and the foam material will support the shank of the arrow to prevent the arrow from falling out of the target. At the point of impact between the arrow and the cloth layer or layers, the tendency to push the cloth through the target is resisted by the intimate contact of the foam material with the entire surface of the cloth layer. Those arrows which miss the cloth layers completely will of course pass substantially or completely through the target but the overall damage to the target is minimized since the majority of the hits will be within the area defined by the cloth layers. After a plurality of arrow penetrations in the vicinity of the cloth layer, the foam material will be fairly well chewed up. However, it will only be necessary to reverse the target 180° to allow the arrows to penetrate the opposite side of the foam body. Thus, the life of the target can be substantially lengthened by the presence of the layer or layers of cloth material.

The type of foam utilized by the target can vary considerably and the surface of the foam target can be suitably decorated in any desired manner. As mentioned previously, the animal target could be in the form of any type of game animal.

While the invention has been particularly shown and described with reference to a preferred embodiment thereof, it will be understood by those in the art that the foregoing and other changes in form and details may be made therein without departing from the spirit and scope of the invention.

What is claimed is:

1. A three dimensional archery target simulating an animal comprising a body portion, a head portion and leg portions molded of foam material in a single unit where said body portion has a vertical median plane extending lengthwise of the body and at least one layer of penetration resistant cloth is integrally molded in said body portion with entire surface of said cloth disposed in direct intimate contact with said foam material and disposed in said median plane coextensive with a desired target area with the edges of the cloth spaced from outer surfaces of said body portion.

2. A three dimensional archery target as set forth in claim 1, further comprising support means integrally molded in said leg portions and extending outwardly therefrom to support the target with the median plane thereof vertically disposed.

3. A three dimensional archery target as set forth in claim 1, further comprising a plurality of layers of penetration resistant cloth having identical dimensions and superimposed on each other in said primary target area.

4. A three dimensional archery target as set forth in claim 3, wherein said penetration cloth is a Rachel knitted fabric of 100 Denier polyester yarn having a three bar construction and having a weight from 10–30 ounces per square yard.

5. A three dimensional archery target as set forth in claim 1, wherein said target is molded in one piece from polyurethane elastomeric foam.

6. A three dimensional archery target comprising a body portion of molded foam material having an outer peripheral surface including front and rear target areas and a vertical median plane spaced between said target areas and at least one layer of penetration resistant cloth integrally molded in said body portion with entire surface of said cloth disposed in direct intimate contact with the molded foam material and disposed in said median plane coextensive with said target area with the edges of the cloth spaced from said outer peripheral surface of said body portion.

7. A three dimensional archery target as set forth in claim 6, further comprising a plurality of layers of penetration resistant cloth having identical dimensions and superimposed on each other coextensive with said target areas.

8. A three dimensional archery target as set forth in claim 6, wherein said penetration resistant cloth is a Rachel knitted fabric of 100 Denier polyester yarn having a three bar construction and having a weight from 10–30 ounces per square yard.

9. A three dimensional archery target as set forth in claim 6, wherein said target is molded in one piece from polyurethane elastomeric foam.

* * * * *